United States Patent [19]

Zaremski et al.

[11] 4,012,299

[45] Mar. 15, 1977

[54] METALLIC DESCALING SYSTEM

[75] Inventors: Donald R. Zaremski, Cheswick, Pa.; Albert Krepler, Vienna, Austria

[73] Assignees: Allegheny Ludlum Industries, Inc., Pittsburgh, Pa.; Ruthner Industrienanlagen Aktiengesellschaft, Vienna, Austria

[22] Filed: Apr. 1, 1976

[21] Appl. No.: 672,585

[52] U.S. Cl. ..... 204/141.5; 204/145 R

[51] Int. Cl.[2] ..... C25F 1/04; C25F 1/06

[58] Field of Search ..... 204/141.5, 145 R

[56] References Cited

UNITED STATES PATENTS

| | | | |
|---|---|---|---|
| 3,043,758 | 7/1962 | Machu | 204/145 R |
| 3,254,011 | 5/1966 | Zaremski | 204/145 R |
| 3,429,792 | 2/1969 | Fukui et al. | 204/145 R |

*Primary Examiner*—T. M. Tufariello

*Attorney, Agent, or Firm*—Vincent G. Gioia; Robert F. Dropkin

[57] ABSTRACT

A process for descaling a metallic body, wherein the body is immersed in a first electrolyte, and subsequently, in a second electrolyte. The first electrolyte is an aqueous solution having, by weight, at least 60% potassium hydroxide, at least 5% water and no more than 30% potassium nitrate, and a total amount of potassium hydroxide and potassium nitrate of at least 80%. The second electrolyte is an aqueous solution of at least one neutral salt from the group consisting of the chloride, sulfate and nitrate of an alkali metal or ammonium.

5 Claims, No Drawings

METALLIC DESCALING SYSTEM

The present invention relates to a metallic descaling process.

As anneals and other heat treatments are often carried out in oxidizing atmospheres, oxide scales are known to form on metallic surfaces. To date, several methods of removing such scales are in commercial use. These methods do, however, necessitate the use of hot mineral acid solutions. Typical methods are disclosed in U.S. Pat. Nos. 3,043,758 and 3,254,011.

Today it is becoming increasingly clear, that there is a need for a descaling process which requires little or no acid pickling. First of all, both the cost of using and of disposing of mineral acids has significantly increased. Secondly, with the continuing tightening of pollution laws, there is a distinct possibility that the dumping of waste acid pickling solutions will not be permitted at some time in the future. Should this occur, metal producers would be forced to install very costly acid regeneration or neutralization plants.

The present invention provides a scale removal system which eliminates or minimizes the need for acid pickling. Applicants have found that such a desirable result could be achieved by immersing a scaled metallic body in a first electrolyte on the order of that disclosed in U.S. Pat. No. 3,254,011, and then in a second electrolyte on the order of that disclosed in U.S. Pat. No. 3,043,758. Such a process is contradictory to the teachings of U.S. Pat. No. 3,043,758, as said patent does not hint upon the use of a first electrolyte; and to that of U.S. Pat. No. 3,254,011, as said patent does not hint upon the use of a second electrolyte.

It is accordingly an object of the present invention to provide a metallic descaling process which eliminates or minimizes the need for acid pickling.

The present invention provides a process for descaling metallic bodies. In its broadest sense, it comprises the steps of immersing a metallic body in a first electrolyte, and subsequently, in a second electrolyte. The first electrolyte is an aqueous solution having, by weight, at least 60% potassium hydroxide, at least 5% water and no more than 30% potassium nitrate, and a total amount of potassium hydroxide and potassium nitrate of at least 80%. The second electrolyte is an aqueous solution of at least one neutral salt from the group consisting of the chloride, sulfate and nitrate of an alkali metal or ammonium.

The first electrolyte conditions the scale for subsequent removal; and generally consists essentially of, by weight, from 65 to 75% potassium hydroxide, from 10 to 20% water and from 10 to 20% potassium nitrate. Immersion time in the electrolyte is at least 3 seconds, and generally in excess of 10 seconds. Times are dependent upon the size of the body being descaled, the type and thickness of the scale, the temperature of the electrolyte, the current density, and upon the time the metal is anodic. Current densities are usually in excess of 0.1 amp per square inch. Electrolyte temperatures are usually in the range of from 350° to 500° F. Current densities, temperatures and times are all, however, dependent upon each other, as well as upon the other listed variables.

Subsequent to being immersed in the first electrolyte, the metal being treated is immersed in the second electrolyte. Immersion time in the second electrolyte is at least 4 seconds, and generally at least 10 seconds. As with the first electrolyte, immersion times are dependent upon several variables, as are current densities and electrolyte temperatures. Current densities are usually in excess of 0.1 amp per square inch. Electrolyte temperatures are usually in the range of from 120° to 200° F. To increase the effectiveness of the electrolyte, 0.1 to 50 grams per liter of a compound from the group consisting of fluorides, chlorides, perchlorates, chromates, nitrites, sulfites, nitrates and sulfates, may be added. The pH of the electrolyte is maintained between 1.0 and 7.0 during the electrolytic process.

Although the invention is believed to be adaptable to a number of metals, alloy steels presently appear to constitute the most significant embodiment thereof. For this reason, the following examples are directed to the removal of scale from stainless steel.

Samples of mill annealed Type 304 and 309 stainless steel were exposed to scale conditioning in an electrolyte of the following chemistry:

70% KOH 15% $KNO_3$ 15% $H_2O$ and then, after rinsing, to a neutral sodium sulfate electrolyte. The solution concentration of sodium sulfate was between 15 and 20% by weight. The first electrolyte was maintained at a temperature of from 400° to 450° F whereas the second electrolyte was mantained at a temperature of from 150° to 170° F. Specifics as to metal gage, times, current densities and polarities are set forth hereinbelow in Table I.

TABLE I

| | | | FIRST ELECTROLYTE | | | | SECOND ELECTROLYTE | | | |
|---|---|---|---|---|---|---|---|---|---|---|
| | | | Current | Time of Immersion (seconds) | | | Current | Time of Immersion(seconds) | | |
| Sample | Type | Gage (inches) | Density (amp./sq.inch) | Anode | Cathode | Anode | Density (amp./sq.inch) | Anode | Cathode | Anode |
| A | 309 | 0.018 | ⅛ | 20 | 20 | 20 | ¾ | 12 | 12 | 12 |
| B | 309 | 0.018 | ⅛ | 20 | 20 | 20 | None | (10 seconds in 15% $H_2SO_4$-170° F) | | |
| C | 304 | 0.030 | ½ | 1 | 1 | 1 | ½ | 6 | 6 | 6 |
| D | 304 | 0.030 | None | (25 second immersion) | | | ½ | 10 | 10 | 10 |

Samples removed from the electrolyte were cleaned and examined for residual scale at a magnification of 20X. The results of the examination appear hereinbelow in Table II. Also appearing in Table II are the results of a salt spray test. The samples were placed in a salt spray cabinet for seven days and subsequently examined for rust. Corrosion resistance of samples is somewhat impaired if scale is not removed.

TABLE II

| Sample | Scale (%) | Salt Spray (% Rust) |
|---|---|---|
| A | 0 | 0.06 |
| B | 50 | 0 |
| C | 0 | 0.06 |
| D | 10 | 0.04 |

The results apearing hereinabove in Table II clearly show that metallic surfaces can be effectively descaled in accordance with the teachings of the present invention. Scale was not detected on the samples treated in accordance with the present invention (Samples A and C), at a magnification of 20X. On the other hand, scale was observable on samples which were not treated in accordance with the present invention (Samples B and D). Sample B, unlike Sample A, did not receive a treatment in a second electrolyte. As for Sample D, electric current was not passed through it and the first electrolyte, as it was for Sample C. Salt spray results were inconclusive as they showed an insignificant amount of attack, if any.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A process for descaling a metallic body, which comprises the steps of: immersing said body in a first electrolyte, said electrolyte being an aqueous solution having, by weight, at least 60% potassium hydroxide, at least 5% water and no more than 30% potassium nitrate, and a total amount of potassium hydroxide and potassium nitrate of at least 80%; passing an electric current through said body and first electrolyte for a period of at least 3 seconds; removing said body from said first electrolyte after scale on said body has been conditioned for subsequent removal; subsequently immersing said body in a second electrolyte of an aqueous solution of at least one neutral salt from the group consisting of the chloride, sulfate, and nitrate of an alkali metal or ammonium; passing an electric current through said body and second electrolyte for a period of at least 4 seconds; and removing said body from said second electrolyte.

2. A process according to claim 1, wherein said first electrolyte consists essentially of, by weight, from 65 to 75% potassium hydroxide, from 10 to 20% water and from 10 to 20% potassium nitrate.

3. A process according to claim 1 wherein said second electrolyte contains from 0.1 to 50 grams per liter of a compound from the group consisting of fluorides, chlorides, perchlorates, chromates, nitrites, sulfites, nitrates and sulfates.

4. A process according to claim 1, wherein the neutral salt is sodium sulfate.

5. A process according to claim 1, wherein said metallic body is an alloy steel.

* * * * *